United States Patent [19]

Neuman et al.

[11] Patent Number: 4,877,954

[45] Date of Patent: Oct. 31, 1989

[54] LIGHT COUNTING SYSTEM FOR CONVEX ARTICLES

[75] Inventors: Arnold I. Neuman, 6 Circle Dr., Mt. Kisco, N.Y. 10549; Thomas D. Heidt, Long Valley, N.J.; Andrew Bergman, Mountain Lakes, N.J.; James Wickstead, Mendham, N.J.

[73] Assignee: Arnold I. Neuman, Mountain Lake, N.J.

[21] Appl. No.: 909,994

[22] Filed: Sep. 22, 1986

[51] Int. Cl.[4] ..... H01J 40/14

[52] U.S. Cl. ..... 250/222.2; 377/53

[58] Field of Search ..... 250/222.2, 222.1, 223 R; 377/6, 53; 235/98 C

[56] References Cited

U.S. PATENT DOCUMENTS

| | | | |
|---|---|---|---|
| 3,234,360 | 2/1966 | Schooley | 377/3 |
| 3,603,457 | 9/1971 | Flodin . | |
| 3,628,025 | 12/1971 | Kieferle . | |
| 3,660,663 | 5/1972 | Guildford et al. . | |
| 3,835,306 | 9/1972 | Bills | 377/53 |
| 4,047,023 | 9/1977 | Key | 250/568 |
| 4,097,725 | 6/1978 | Lieberman | 377/53 |
| 4,151,402 | 4/1979 | Fernandez | 377/53 |
| 4,217,491 | 8/1980 | Dufford | 377/53 |
| 4,410,804 | 10/1983 | Stauffer . | |
| 4,481,667 | 11/1984 | Price | 377/6 |
| 4,528,446 | 7/1985 | Dunaway . | |
| 4,580,280 | 4/1986 | Hetrick | 377/53 |

*Primary Examiner*—David C. Nelms
*Assistant Examiner*—Jessica Ruoff
*Attorney, Agent, or Firm*—Blum Kaplan

[57] ABSTRACT

An apparatus for counting hangers having a convex surface includes a housing having a central light source carried by the housing for projecting a light beam on the convex surface. A pair of spaced light detectors is positioned on the housing substantially on opposed sides of the central light source, the spaced light detectors detect light reflected from the convex surface. A detecting circuit is connected to the pair of spaced light detectors and detects the sequence of reflected light beams, and then determines whether the detected sequence is a sequence of reflected light beams characteristic of the relative displacement of the housing and the convex surface when the housing or the convex surface is displaced in substantially the direction of the space between the pair of opposed light detectors.

37 Claims, 6 Drawing Sheets

2
2
10
11
12
13
14
16
18
22
24
25
26
27
28
28
30
35
57
72
A2

11
13
17
18
19
21
21
22
22a
24
27
28
30
31
32
34
35
35
36
38
5
5
72
A2

LIGHT COUNTING SYSTEM FOR CONVEX ARTICLES

BACKGROUND OF THE INVENTION

This invention relates to hanger counters in general, and in particular, to hanger counters which use a light source and detectors.

Hanger counters employing photosensors are known in the art as is exemplified in U.S. Pat. No. 4,151,402. This prior art counter passed specially designed hangers past a photo-electric detector in which the reflection of the hanger, or the breaking of a beam would be detected. U.S. Pat. No. 4,097,725 also teaches detecting the number of hangers by passing a hanger through a beam of light, and detecting the breaking of the beam of light.

These prior art hanger counting devices have not been satisfactory. They suffer from the disadvantage of being limited to use in connection with specially constructed hangers. A further disadvantage is that the hangers must be passed through two halves of the device, which limits the mobility, adaptability and speed of use of the hanger counter. This arises from the fact that the principal need for hanger counters is in the counting of hangers on a rack as a quick method of counting garments for inventory, verification of shipping documents and other purposes. Accordingly, it is desirable to provide a hanger counter which overcomes the shortcomings of the prior art devices described above.

SUMMARY OF THE INVENTION

Generally speaking, in accordance with the invention, a hanger counter adapted to identify light reflected from a convex surface as the counter moves relative to the hanger is provided. The counter has a housing containing a light source for projecting light upon the convex surface. A pair of photodetectors for detecting light reflected off of the convex surface of the hanger are situated on the housing on opposed sides of the light source. Each photodetector is coupled to a detecting circuit for detecting a sequence of actuations having the characteristics of reflections from a convex surface as the housing is displaced relative to the convex surface. The detecting circuit is connected to an indicator for providing a visual or audible indication that the proper sequence has been detected, and a counting means for counting each successive detected sequence.

A guide is affixed to the housing to facilitate the relative displacement of the hanger to the light source. The guide is formed with a curved inner surface which substantially corresponds to the curve of a hanger hook, the cross section of which defines an upper convex surface. The guide inner surface has a leading and trailing portion each of which is curved in a generally upward direction to allow smooth passage over each successive hanger.

In an alternative embodiment a single photodetector for detecting reflected light is positioned within the housing. Two light sources are situated in the housing on substantially opposite sides of the photodetector. The photodetector is coupled to a detecting circuit for detecting a sequence of reflected light beams characteristic of the relative displacement of the housing and convex surface. The light sources can be coded, as by a modulator so that the detecting circuit can identify the sequence of detected light and distinguish the desired convex surface.

The housing is preferably hand held and battery powered for ease of use.

It is an object of this invention to provide an improved hanger counter.

Another object of this invention is to provide a more portable hanger counter.

Another object of this invention is to provide a hanger counter which counts hangers by detecting the convex surface of each hanger without the need of utilizing special hangers.

A further object of this invention is to provide a hanger counter which makes use of the reflected light from the convex surface of the hanger.

Still other objects and advantages of the invention will in part be obvious and will in part be apparent from the specification and drawings.

The invention accordingly comprises features of construction, combinations of elements, and arrangements of parts which will be exemplified in the construction hereinafter set forth and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
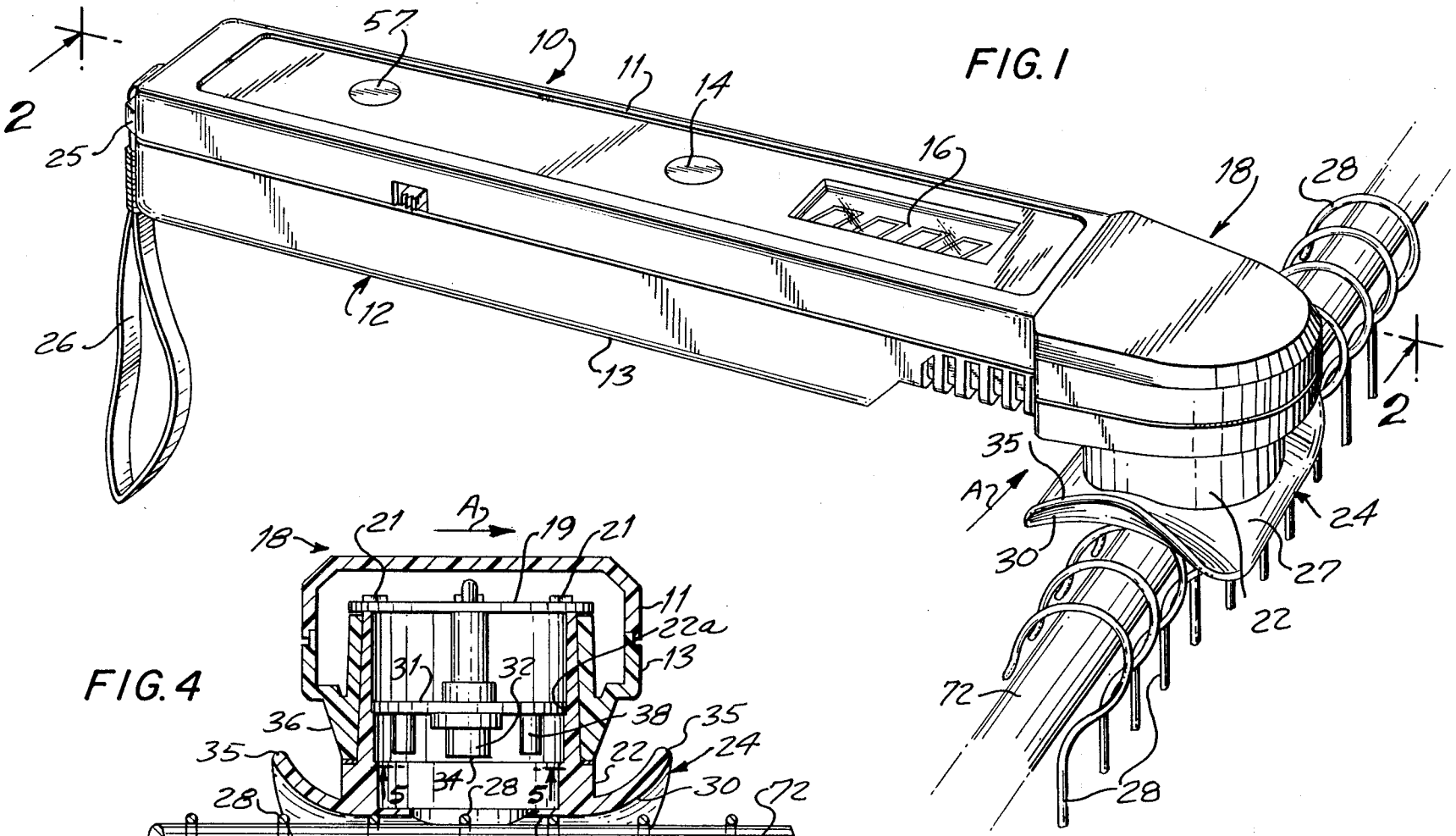
FIG. 1 is a perspective view of a hanger counter in accordance with the invention operatively positioned in relation to a rack of hangers.
Figure 4:
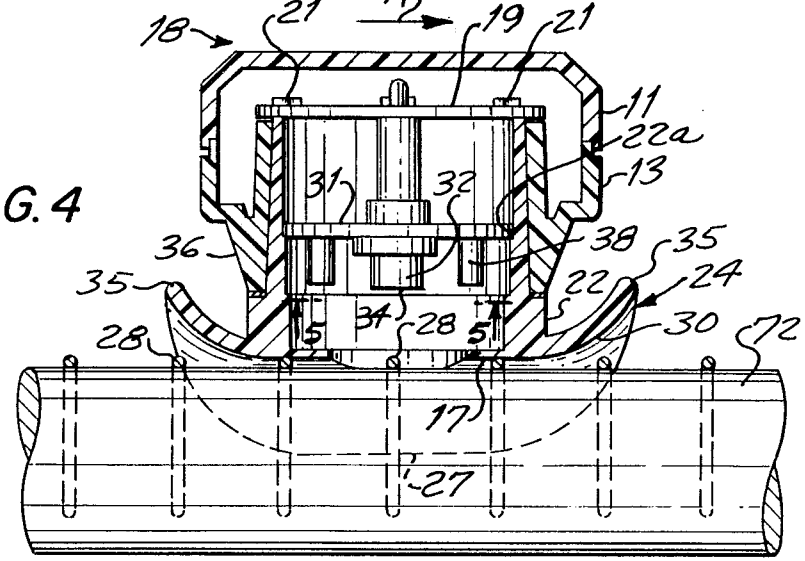
FIG. 4 is a front elevational sectional view taken along line 4—4 of FIG. 3.

Reference is made to FIGS. 1-5, wherein a hanger counter, generally indicated as 10, includes a handle portion 12 and a head portion 18. The handle and head portions of the hanger counter are formed from a housing including an upper body 11 and a lower body 13 which mates with upper body 11 and is joined thereto by screws 49*a* and 49*c*. The housing also includes a guide member 22 in the head portion thereof which is received in an opening 13*a* in lower body 13. Guide member 22 is provided, at its upper end with three tabs 21 which extend into corresponding openings in cover 19 and are heat staked to hold the guide member in place. Buttons 14 and 57, the purpose of which are described more particularly below are located on handle portion 12 of upper body 11. A window 16 is also mounted in an opening in handle portion 12 of upper body 11. Upper body 11 is formed with a bail 25 for receiving a strap 26 to facilitate transportation and handling of hanger counter 10.

Guide member 22 is formed with a complexly curved, smooth lower guide surface 30, in part defined by curved flange 24. Flange 24 of guide member 22 extends beyond head 18 laterally (in the longitudinal direction of rack 72 on which hangers 28 are mounted) in upwardly extending wings 35 to allow for a larger curved surface to facilitate the passage of head 18 over hangers 28. Flange 24 extends forwardly and rearwardly in downwardly extending portions 27 for assisting in the positioning of the head over the hooks of hangers 28. The radius of curvature of surface 30 between portions 27 of flange 24 is preferably greater than the radius of curvature of said hanger hook portion as shown in FIG. 2.

Guide member 22 is hollow and formed with an end wall 17 defining a light opening 20. Supported within guide member 22 on rim 22*a* is a support plate 31 formed with a notch 23 in one edge for mating with an inner projection 23*a* formed on guide member 22 (FIG. 5) for correctly orienting plate 31 and the members supported thereby.

Figure 6:
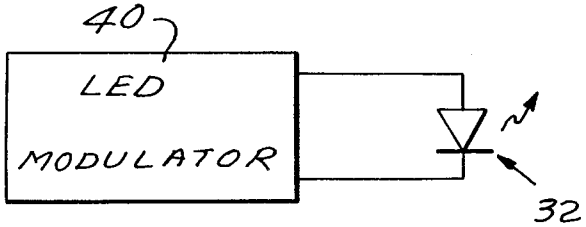
FIG. 6 is a schematic diagram of a light source circuit in accordance with the invention.

An infrared light source 32 is centrally positioned on plate 21 so that it may project an infrared light beam through opening 20 upon each hanger 28 as head 18 passes over each hanger 28 In the preferred embodiment, a light emitting diode is used as the light source, but any source of light may be used. A slit 34 is provided on light source 32 to focus the light beam into a rectangular pattern extending in a direction parallel to the hanger, thereby reducing the amount of background light produced by light source 32 as well as aiding in the directing of the reflection. Furthermore, the light source is modulated at a predetermined frequency by means of a modulator 40 (shown in FIG. 6) to help in filtering out background signals. In the preferred embodiment a frequency of 75 KHz is provided by an oscillator in LED modulator 40 to, in effect, code the light beam so that it can be distinguished from spurious light sources.

Figures 2, 3, 5:
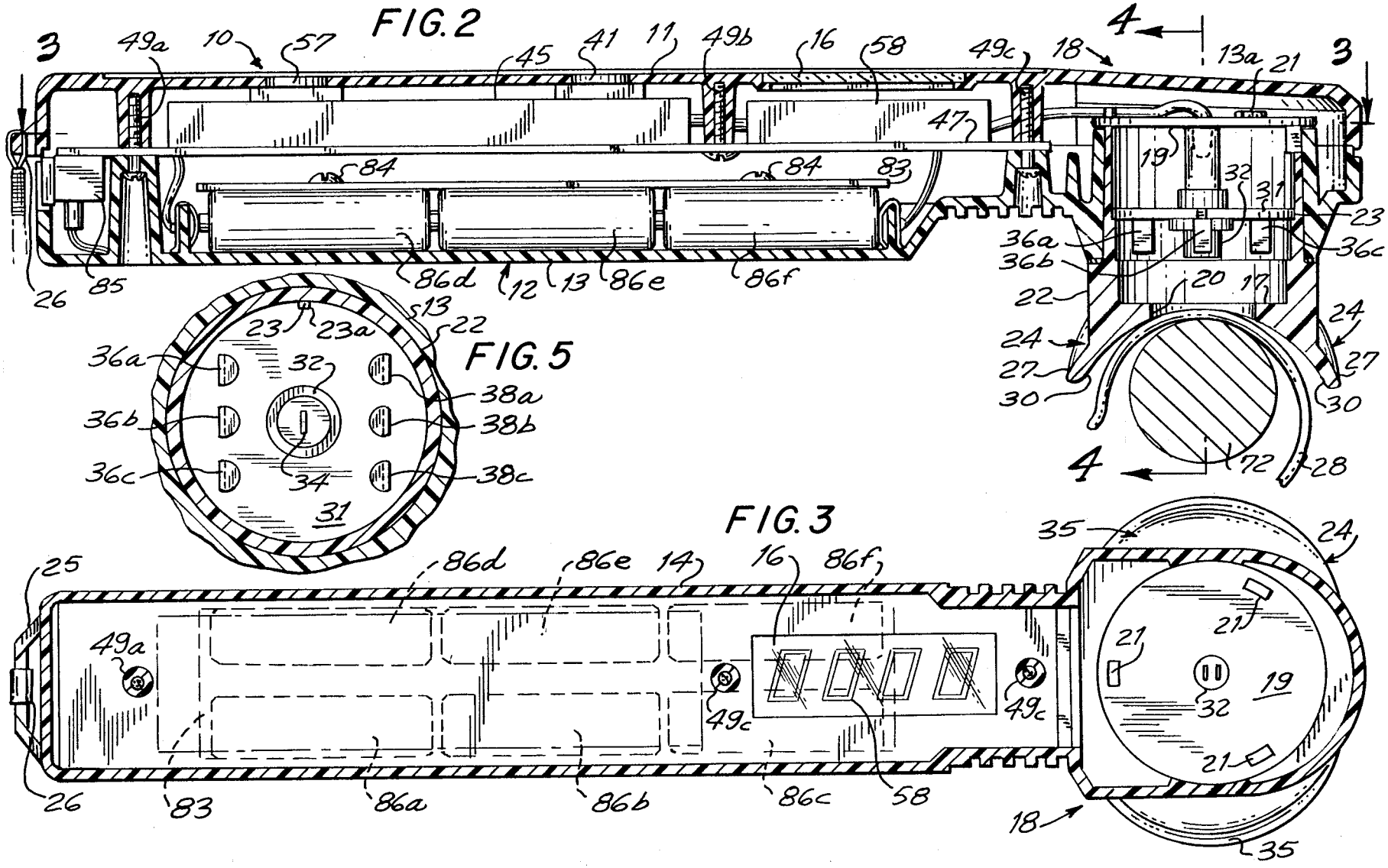
FIG. 2 is a sectional view taken along line 2—2 of FIG. 1.
FIG. 3 is a sectional view taken along line 3—3 of FIG. 2.
FIG. 5 is a fragmentary sectional view taken along line 5—5 of FIG. 4.

Two groups of photodetectors 36*a*, 36*b*, and 3*c* and 38*a*, 38*b* and 38*c* (hereinafter 36 and 38 unless otherwise specified) for detecting light reflected from the convex surfaces of hangers 28 through opening 20 are mounted on plate 25 in two lines essentially parallel lines in spaced relation on opposed sides of light source 32, essentially parallel to slit 34 (FIG. 5). A detecting circuit 46 (described below) detects the infrared light received by each of photodetectors 36,38 and determines whether a hanger has been passed or not. In the preferred embodiment three photodetectors coupled in parallel are positioned on each side of light source 32, but the device will function with as few as one photodetector on each side of light source 32. Furthermore, the detecting circuit will operate on the input of any one detector as well as all three combined. This allows for greater angular tolerance in the positioning of head 18 relative to hanger 28.

Figure 9A:
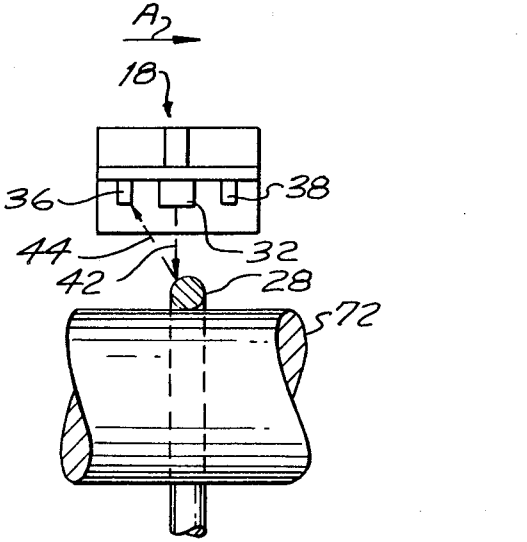
FIGS. 9A, 9B and 9C are sequentially positioned schematic views of the hanger counter of FIG. 1 relative to a hanger showing the hanger counter in operation.
Figure 9B:
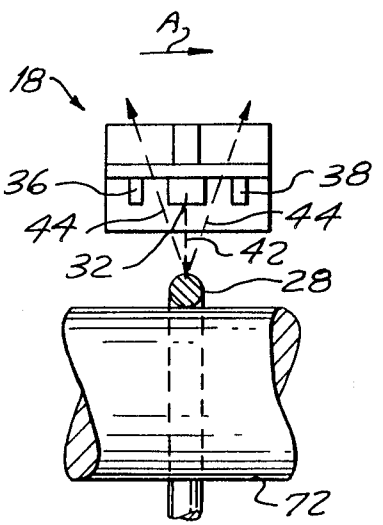
Figure 9C:
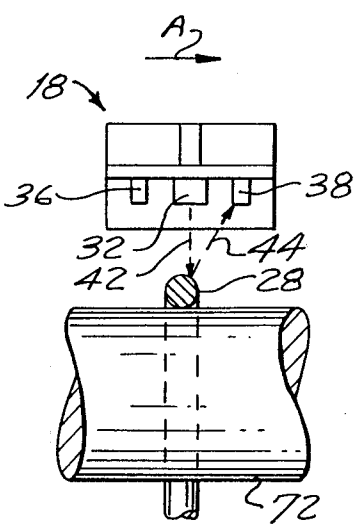

Reference is now made to FIGS. 9A, 9B and 9C where operation of head 18 is depicted. Light source 32 is continuously projecting a beam of light 42. As head 18 is passed in the direction of arrow A of FIGS. 1, 4, 9A, 9B and 9C, the lead photodetectors 38 pass over hanger 28. As head 18 moves further along, light source 32 then passes over hanger 28 and beam of light 42 comes in contact with the upwardly curved portion of the concave surface defined by the cross section of hanger 28 and is reflected back in beam of light 44 towards trailing photodetector 36 (FIG. 9A). At positions between photodetectors 36 and 38 the beams of reflected light 44 are undetected (FIG. 9B). As light source 32 continues to pass over hanger 28, beam of light 42 contacts the downwardly curved portion of the concave surface of hanger 28 and beam of light 44 is reflected towards lead photodetector 38 (FIG. 9C). Due to the shape of a concave surface and the reflecting properties of light, as head 18 passes over hangers 28 in the direction of arrow A, the beam of light will always be reflected to each detector in the order of trailing detector first, lead detector second. Furthermore, only a convex surface has this property to reflect light in this manner as the light source passes across it. This enables detecting circuit 46, described below, to determine whether a convex surface is present by merely determining the sequence of light received by photodetectors 36 and 38.

Figure 7:
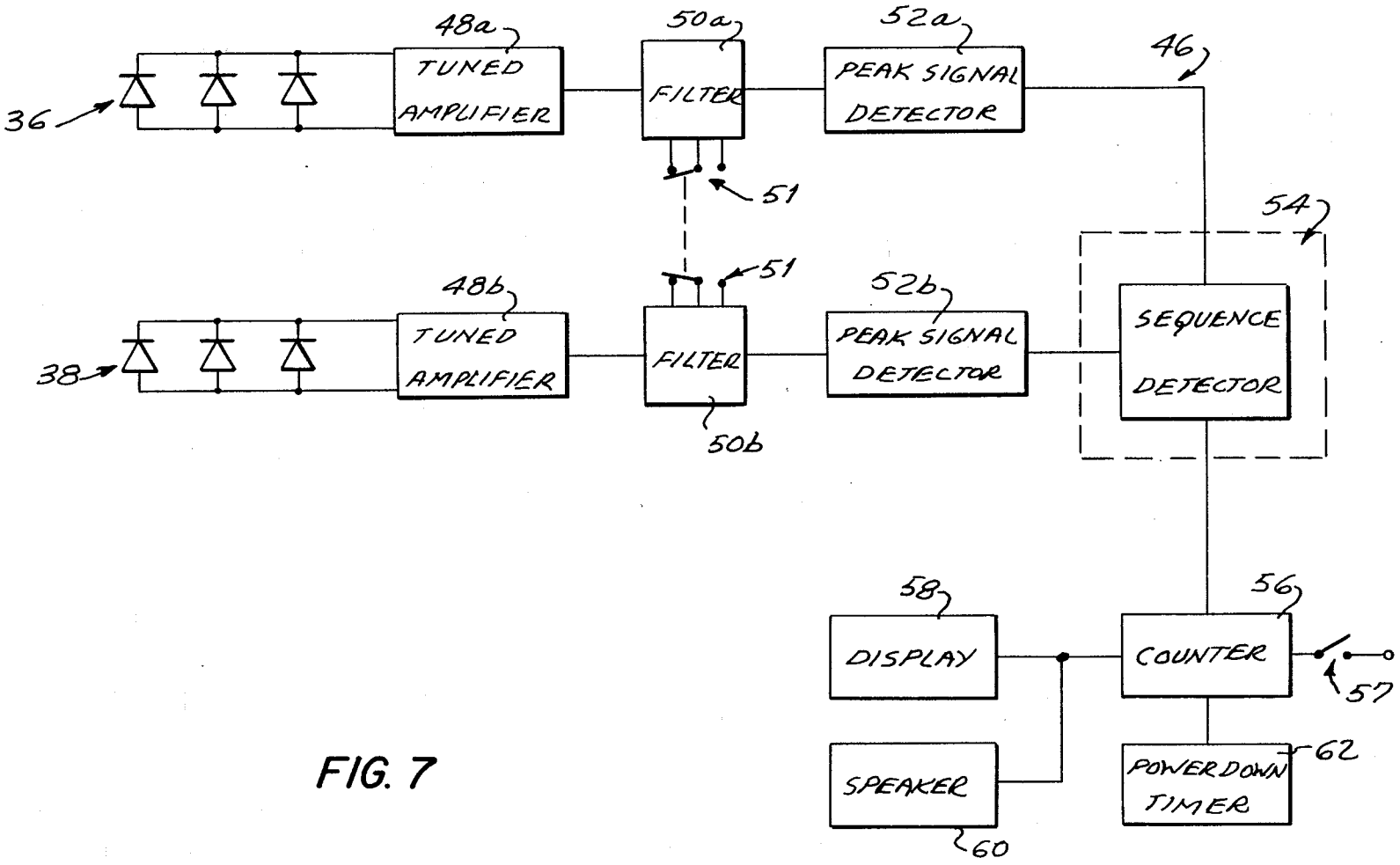
FIG. 7 is a schematic diagram of a detecting circuit in accordance with the invention.

Reference is made to FIG. 7 which depicts a detecting circuit, generally indicated as 46, for detecting the sequence of light signals received from photodetectors 36,38, generated by the light beam from light source 32 reflected from hanger 28. Each array of photodetectors is coupled to an identical signal processing branch, therefore where appropriate, only the processing of the signal to photodetectors 36 will be discussed. Photodetectors 36*a,b,c* are placed in parallel to each other, and are connected in parallel, the parallel connection thereof is coupled as an input to a tuned amplifier 48*a*. Tuned amplifier 48*a* amplifies only signals having the same frequency as LED modulating circuit 40. Therefore, tuned amplifier 48 acts as a decoder, which helps eliminate signals from spurious light sources by amplifying only that portion of the output of photodetectors 36 which is in the frequency range of light beam 42. A filter 50*a* is connected to tuned amplifier 48*a* and further filters the background noise from the output of tuned amplifier 48*a*.

Filter 50*a* is selectively controlled by a double throw switch 51 mounted on the side of handle 18 (FIG. 1). Switch 51 permits filter 50*a* to be adjusted so as to better accommodate the signal characteristic of a wire hanger (which is generally of round cross section) or to better accommodate the signal characteristic of a plastic hanger which is generally larger and has a flat top surface and inclines on either side of the flat surface which correspond to the upwardly curved and downwardly curved portions of a convex surface.

A peak signal detector 52*a*, preferably in the form of a differentiator/limiter circuit, is coupled to the output of filter 50*a*, and determines the peak of the reflected signal. The signal is in the form of a sine wave, so that the peak occurs at the zero crossing. In like manner, photodiodes 38 are coupled to tuned amplifier 48*b*, which is in turn coupled to filter 50*b* which is also adjusted by switch 51. The output of filter 50*b* is coupled to peak signal detector 52*b*.

A sequence detector 54 has a first input from peak signal detector 52a and a second input from peak signal indicator 52b. Sequence detector 54 determines whether the input from photodetector 36 has occurred before the input from photodetector 38 and whether this proper sequence occurred at a proper time. If the signal occurred in the proper sequence and within the proper time, sequence detector 54 produces an output to a counter 56, which maintains a count of the hangers 28. Indicators are connected to counter 56, so that each time counter 56 receives an output from sequence detector 54, the indicator signals the user that this has occurred. In the preferred embodiment, a liquid crystal display 58 and a speaker 60 are connected to counter 56 so that each time the proper sequence is detected, it is noted both visually and audibly. Display 58 is mounted n board 47 in line with window 16 (FIG. 2) and displays the count of counter 56. The counter may be reset by button switch 57 on the top surface of handle 12 (FIGS. 1 and 2), which provides a signal to the reset input of the counter. A power down timer 62 is connected to counter 56 and causes the power to the electrical components of hanger counter 10 to shut off if a signal from counter 56 has not been received within a predetermined period of time. Power is turned on by button switch 14 on the top surface of handle 12, Detection circuit 46 is affixed to a board 47 contained within handle 10. Board 47 is secured in handle 10 by means of screws 49a, 49b and 49c and also supports circuit components shown schematically in FIG., 2 by block 45.

Figure 8:
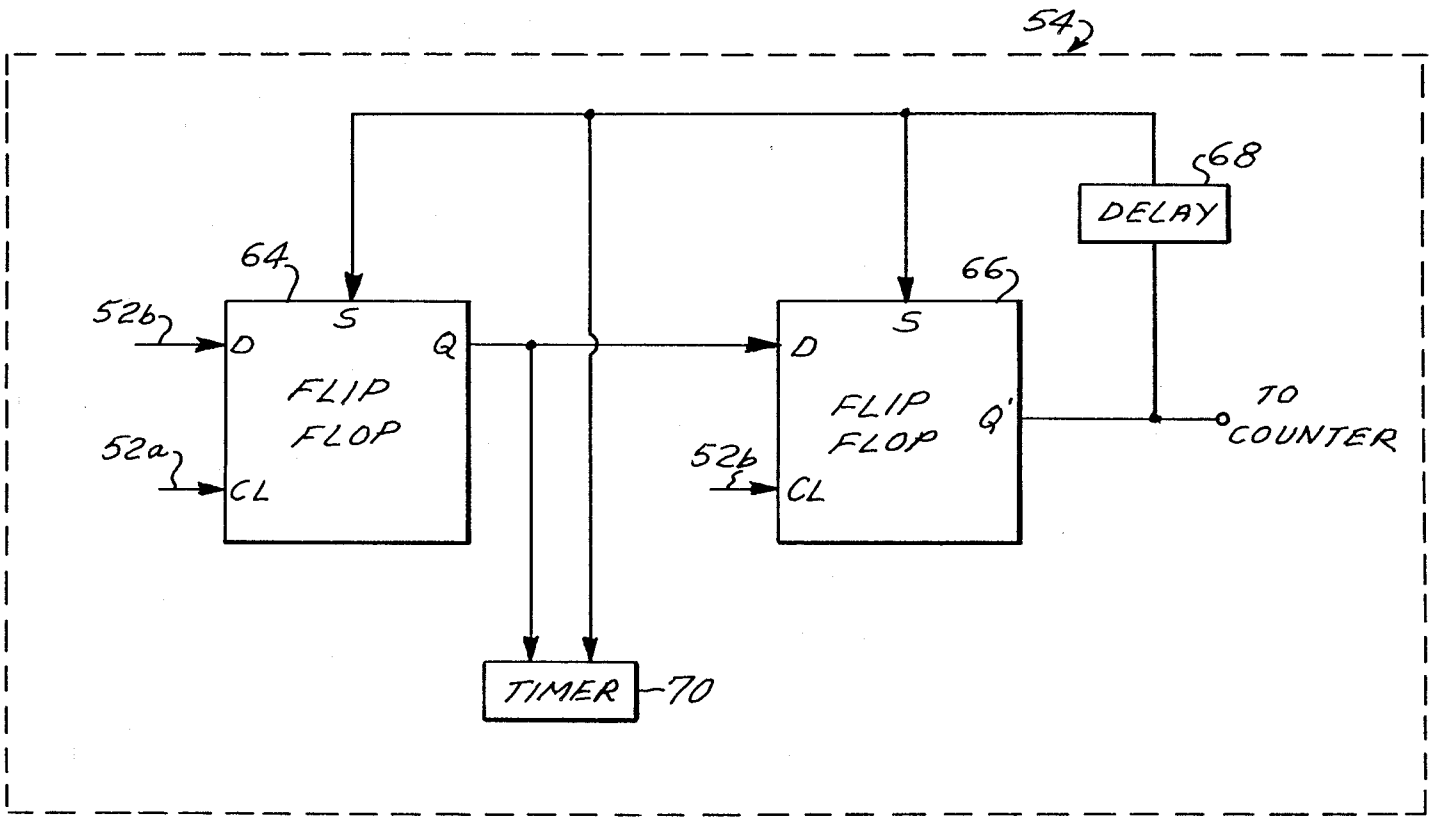
FIG. 8 is a circuit diagram of a sequence detecting circuit in accordance with the invention shown in FIG. 6.

Reference is now made to FIG. 8 wherein sequence detector 54 is depicted in greater detail. Sequence detector 54 includes a pair of D-type flip-flops in series. A first flip-flop 64 has as its clock input the signal from peak signal detector 52a which is the peak signal from photodetectors 36, and the output from peak signal detector 52b as its D input, which is a peak signal received from photodetectors 38. Flip-flop 64 produces an output Q, which is the same signal as its D input when it receives a signal from peak signal detector 52b at its clock input. A second D type flip-flop 66 has as its clock input the output from peak signal detector 52b, which is the peak signal produced by photodetectors 38, and has a D input from the Q output from flip-flop 64. Flip-flop 66 produces an output Q' to counter 56. A delay 68 is coupled between the Q' output of i flip-flop 66 and set terminals S of both flip-flop 64 and flip-flop 66. A timer 70 receives the input from flip-flop 64 and also produces a set output to both flip-flops 64 and 66 a predetermined time after a Q.

As described above in connection with FIGS. 9A, B and C, light will be detected by photodetectors 36 before it is detected by photodetectors 38. Therefore, a signal should be produced by peak signal detector 52a before a signal is produced by peak signal detector 52b and within a predetermined time period based on a range of speeds of displacement of hanger counter 10 in the direction of arrow A. Flip-flops 64 and 66 are set by a signal to their S inputs so that their respective Q and Q' outputs are at the one level and the D input of flip-flop 64 is at zero while the D input of flip-flop 66 is at one. Flip-flop 64 produces a Q output which matches the D input when the leading edge of a detection signal from peak signal detector 52a is applied at its clock input. The leading edge of the signal generated by photodetectors 36 in peak signal detector 52a causes the Q output of flip-flop 64 to become zero, starting timer 70 and setting the output of flip-flop 66 to zero. Thereafter, if photodetectors 38 generate a signal at peak signal detector 52b within the predetermined time, the leading edge thereof applied to the clock of flip-flop 66, applies a zero to the Q' output thereof, and indexes counter 56. This zero signal, after a delay, sets flip-flop 64 and 66 to receive the next input from detectors 36 from the next hanger by setting their respective Q and Q' outputs to one.

However, if light is detected at photodetector 38 before it is detected at photodetector 36, the clock input from peak signal detector 52b arrives at the clock input of flip-flop 66 before the D input from flip-flop 64 and there is no Q' output to counter 56. Therefore, if for some reason head 18 is displaced backwards along hangers 28 or if reflections are from other than a convex surface, the sequence of signals produced will be reversed and no output will be produced by sequence detector 54. In the preferred embodiment, the predetermined level of timer 70 is a quarter of a second.

Hanger counter 10 is operated by pressing on button 14 which activates the power source connected to light source 32 and detection circuit 46. In the preferred embodiment, rechargeable batteries 86a, 86b, 86c, 86d, 86e and 86f are secured within handle 12 by a plate 83 are used, but any suitable power source current may be used. Plate 83 is held in place by screws 84. Recharger socket 85 is mounted in the rear of handle 18 and provides a coupling between batteries 86 and an external charging unit. Head 18 is passed over the backs of a series of hangers 28 on a rack 72 for detection and counting. There is no need to touch hangers 28 with head 18 as hanger counter 10 will work a distance away from the convex surface to be detected. If one wishes to bring head 18 in contact with hangers 28, guide 22 facilitates counting by allowing head 18 to easily glide over hangers 28 due to curved flanges 24. As noted above, a concave curved section of surface 30 of guide member 22 aids in positioning head 18 relative to hangers 28.

Due to the nature of light reflecting off a convex surface, if head 18 is passed over a concave surface, the reflected light of light beam 42 will be detected by the leading photodetectors 38 first and the trailing photodetectors second. This sequence of operation will not produce an output to counter 26. Detector circuit 46 determines if reflected light has arrived in the proper sequence and, if so, will indicate a count by an audible noise as well as at liquid crystal display 58.

Due to the structure of detecting circuit 46, if the sequence is not proper then no count will be indicated. Therefore, if accidentally head 18 is moved in a backwards direction, passing over previously counted hangers, these hangers will not be counted by the detecting circuit. However, it is possible to reverse the inputs to flip-flops 64 and 66, by means of a switch (not shown) or a simple rewiring of the circuitry, so that convex surfaces will be read in the opposite direction and not the forward direction. This simple adjustment enables hanger counter 10 to be equally usable by right handed users and left handed users. Furthermore, due to the structure of the detecting circuit, beams of light reflected off an underlying support rod 72 will not register as the light reflected from rod 72 will will either not be detected by the photodetectors, or will not be detected in the desired sequence.

The hanger counter in accordance with the invention can be easily adapted to detect concave surfaces. In a concave surface, lead photodetector 38 will receive reflected light beam 42 before trailing photodetector 36. This is due to the fact that in an indentation, light is reflected in the opposite direction than when it hits a convex surface. Therefore, if the inputs to sequence detector 54 were reversed, the concave surfaces would be detected as head 18 was moved in the forward direction. Accordingly, the invention can be applied to counted objects other than hangers, including objects having both concave and convex surfaces.

Figure 10C:
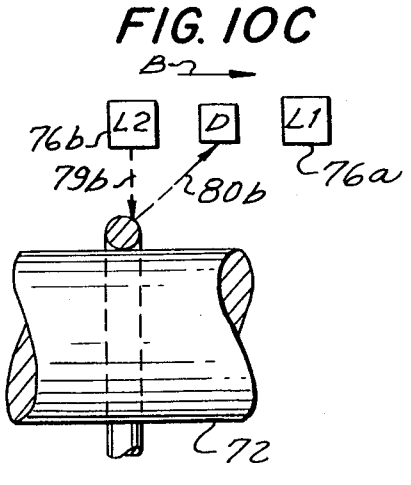
FIGS. 10A, 10B and 10C are sequentially positioned schematic views of an alternative embodiment of the hanger counter in accordance with the invention.
Figure 10B:
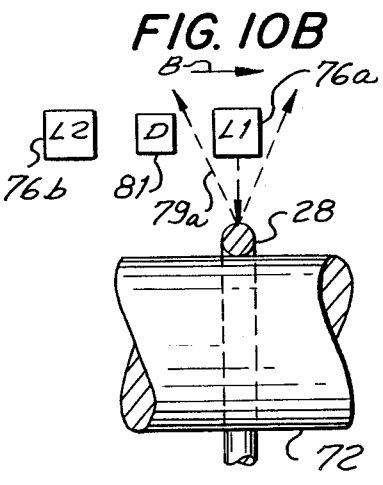
Figure 10A:
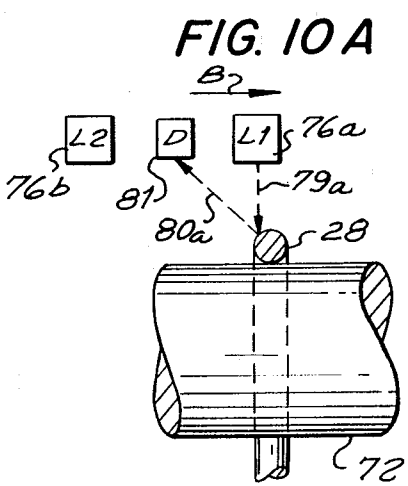
Figure 11:
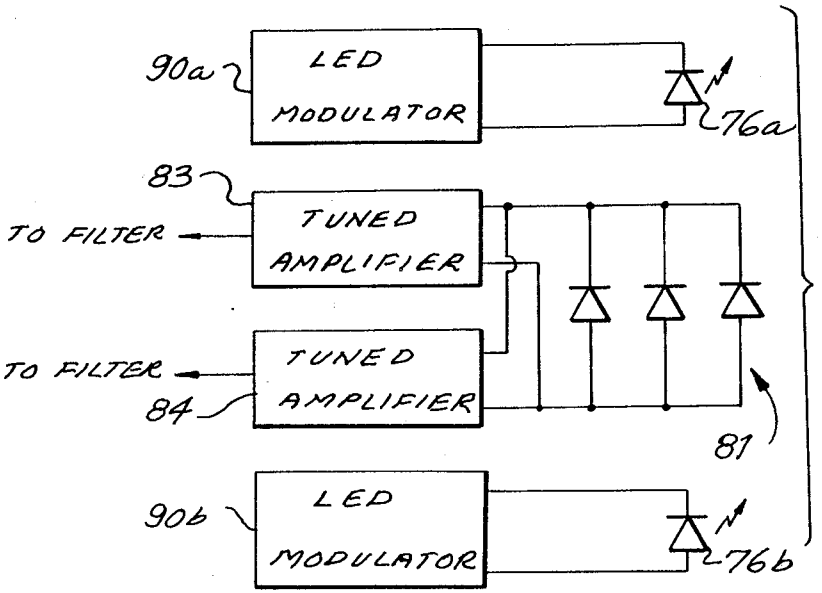
FIG. 11 is a schematic diagram of the light source circuits and photodetector circuit portions of the detecting circuit in accordance with the alternative embodiment of FIG. 10.

Reference is now made to FIGS. 10 and 11 wherein an alternate embodiment is depicted. Specifically, the head contains a pair of spaced light sources, 76*a* and 76*b*. Each light source produces light of a different frequency by reason of its being driven by a different LED modulator 90*a* and 90*b* (FIG. 10). Light sources 76*a* and 76*b* are each focused so that light beam 79*a* and 79*b* are respectfully produced by each light source to single photodetector 81 or to a line of photodetectors positioned in the head intermediate light sources 76*a* and 76*b*. As lead light source 76*a* moves towards a hanger 28, light beam 79*a* will strike the upwardly curved portion of the convex surface of hanger 28 and will be reflected as beam 20*a* to photodetector 81 (FIG. 10A). As head 74 is moved forward in the direction of arrow B, light beam 80*a* is reflected away from detector 18. No light produced by either light source is reflected onto detector 81 until trailing light source 76*b* reflects a beam of light 80*b* from the downwardly curved portion of hanger 28 to photodetector 81.

As shown in FIG. 10, photodetector 81 is coupled to a first tuned amplifier 83 and a second tuned amplifier 84. Tuned amplifier 83 amplifies those signals which have the same frequency as light source 76*a* and tuned amplifier 84 amplifies only those signals which have the same frequency as light source 76*b*. As the head passes over hanger 28, light source 76*a* passes over hanger 28 before light source 76*b* does. Therefore, a signal from light source 76*a* should be detected before a signal from light source 76*b*. Once a signal has been processed by the respective filters, the detecting circuit operates in exactly the same manner as described above for detecting circuit 46. Therefore, it is possible to detect a convex surface utilizing two light sources and a single detector.

As used herein "convex surface" refers to a curved convex surface, a triangular surface, a truncated pyramidal surface and any other surface having an upwardly sloped portion on one side and a downwardly sloped portion on the other and no undulations therebetween sufficient to be detected.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for counting hangers having a convex surface comprising: a housing; a central light source means carried by said housing for projecting a light beam on the convex surface; a pair of spaced light detection means positioned on said housing substantially on opposed sides of said central light source means for detecting light reflected from the convex surface; and detecting circuit means coupled to the central light detection means for detecting a sequence of reflected light beams characteristic of the relative displacement of the housing and the convex surface in substantially the direction of the space between said pair of opposed light detection means and the direction of the curvature of the convex surface.

2. An apparatus for counting hangers, as claimed in claim 1, further comprising an indicator means coupled to the detecting circuit means for indicating when a proper sequence of reflected light beams has been detected by the detecting circuit means representative of the count of a hanger.

3. An apparatus for counting hangers as claimed in claim 1, further comprising a counter means coupled to the detecting circuit means for counting each successive detection indication of the convex surface of a hanger.

4. An apparatus for counting hangers, as claimed in claim 1, further comprising a light beam coding means coupled to the light source means for coding the beam of light produced by the central light source means.

5. An apparatus for counting hangers, as claimed in claim 1, further comprising a guide means adjacent the light source means and light detection means carried by the housing for guiding the apparatus along a group of hangers.

6. The apparatus for counting hangers, as claimed in claim 5, wherein the guide means includes an upwardly inclined leading guide surface for preventing uncounted hangers from blocking the relative displacement of the housing and hangers.

7. The apparatus for counting hangers, as claimed in claim 6, wherein the guide means includes first and second downwardly inclined guide surfaces on opposed sides of the light source means and light detection means for aiding in the positioning thereof having relative displacement of the housing and hangers.

8. The apparatus for counting hangers, as claimed in claim 5, wherein the guide means includes first and second downwardly inclined guide surfaces on opposed sides of the light source means and light detection means for aiding in the positioning thereof having relative displacement of the housing and hangers.

9. The apparatus for counting hangers, as claimed in claim 5, wherein the guide means includes a radially projecting flange surrounding the path of light from the light source means and to the light detection means, said flange including upwardly inclined leading and trailing portions and downwardly inclined side portions.

10. An apparatus for counting hangers, as claimed in claim 3, further comprising a light beam coding means coupled to the light source means, for coding the central light source means.

11. The apparatus for counting hangers, as claimed in claim 10, wherein the light beam coding means comprises modulating means coupled to the central light source means which oscillates the light beam produced by said central light source means at a predetermined frequency.

12. An apparatus for counting hangers having a convex surface comprising a housing; a central light source means carried by said housing for projecting a light beam on the convex surface; a pair of spaced light detection means positioned on said housing substantially on opposed sides of said central light source means for detecting light reflected from the convex surface; detecting circuit means coupled to the central light detection means for detecting a sequence of reflected light beams characteristic of the relative displacement of the housing and the convex surface in substantially the direction of the space between said pair of opposed light detection means and the direction of the curvature of the convex surface; and a light beam coding means coupled to the light source means, for coding the central light source means including modulating means coupled to the central light source means which oscillates the light beam produced by such central light source means at at a predetermined frequency; the detecting circuit means including a first tuned amplifier means coupled to a first light detection means of the pair of spaced light detection means; a second tuned amplifier means coupled to the second light detection means of the pair of spaced light detection means, each of said tuned amplifier means being set to principally amplify those signals having the frequency produced by the light beam coding means; a first peak signal determining means coupled to said first tuned amplifier means; a second peak signal determining means coupled to said second tuned amplifier means, each of said peak signal determined means for determining the peak of the signal received from the respective light detection means; a sequence detector means coupled to said first and second peak determining means for determining whether the detection of reflected light detected by said first light detection means and said second light detection means occurred in the proper sequence, producing an output representative of the count of a hanger only if a proper sequence has been detected.

13. The apparatus for counting hangers, as claimed in claim 12, and including a first filter means intermediate the first tuned amplifier means and the first peak signal determining means, and a second filter means intermediate the second tuned amplifier means and the second peak signal determining means.

14. The apparatus for counting hangers, as claimed in claim 13, and including switch means on said housing, said first and second filter means being adapted to be tailored to the characteristic signals of a metal or plastic hanger in response to the setting of the switch means.

15. The apparatus for counting hangers, as claimed in claim 12, wherein the sequence detector means includes timer means for resetting the sequence detector means when the input from the delay between the signals from the first and second peak signal determining means exceeds a predetermined level.

16. The apparatus for counting hangers, as claimed in claim 15, wherein the sequence detector means includes a first and a second D-type flip-flops coupled so that the output of the first peak signal determining means is applied as the clock to the first flip-flop means, the output of the second peak signal determining means is applied as the data input to the first flip-flop means and the clock input to the second flip-flop means and the output of the first flip-flop to the data input of the second flip-flop means and the output of the first flip-flop means is applied to the input of the timer means the output of this second flip-flop means comprising the output of the sequence detector means.

17. The apparatus for counting hangers, as claimed in claim 16, and including delay means coupled to the output of the second flip-flop means, the outputs of the delay means and the timer means setting the first and second flip-flops.

18. The apparatus for counting hangers, as claimed in claim 1, wherein the light detection means is an infrared photodetector and the light source means is an infrared light source.

19. The apparatus for counting hangers, as claimed in claim 18, wherein the light source comprises a light emitting diode.

20. The apparatus for counting hangers, as claimed in claim 2, wherein the indicator means comprises a speaker, said speaker producing a predetermining sound when a proper sequence of reflected light beams has been detected by the detecting circuit means.

21. The apparatus for counting hangers, as claimed in claim 3, wherein the indicator means further comprises a Liquid Crystal display means for visually indicating the count of the counter means.

22. The apparatus for counting hangers, as claimed in claim 1, wherein the housing is dimensioned to be held in a hand of an operator.

23. The apparatus for counting hangers, as claimed in claim 22, wherein the housing includes an elongated handle portion for grasping by the hand of the user and a lead portion including the light source means and light detection means.

24. The apparatus for counting hangers, as claimed in claim 23, and including battery means mounted in said elongated handle portion for powering the apparatus.

25. The apparatus for counting hangers, as claimed in claim 1, further comprising a first light beam coding means coupled to a first light source means of the pair of spaced light source means; a second light beam coding means coupled to the second light source means of the pair of spaced light source means, each of said light beam coding means for coding the beam of light produced by each respective spaced light source means and said first light beam coding means coding the beam of light produced by the first light source means so that it may be differentiated from the coded light source of the second light source means.

26. The apparatus for counting hangers, as claimed in claim 25, wherein the detecting circuit means comprising a first tuned amplifier means coupled to the central light detection means; a second tuned amplifier means coupled to the central light detection means, said first tuned amplifier being set to principally amplify those signals having the frequency produced by the first light beam coding means, and said second tuned amplifier means being set to principally amplify those signals having the frequency produced by the second light beam coding means; a first peak signal determining means coupled to said first tuned amplifier means; a second peak signal determining means coupled to said second tuned amplifier means, each of said peak signal determining means for determining the peak of the signal received from the respective tuned amplifier means; a sequence detector means coupled to said first and second peak determining means for determining whether the detection of reflected light detected by the central detection means occurred in the proper sequence, producing on output representative of the count of a hanger and if a proper sequence has been detected.

27. An apparatus for detecting a curved surface comprising: a housing; a central light source means carried by said housing for projecting a light beam on the curved surface; a pair of spaced light detection means positioned on said housing substantially on opposed sides of said central light source means for detecting light reflected from the curved surface; and detecting circuit means coupled to the pair of spaced detection means for detecting a sequence of reflected light beams characteristic of the relative displacement of the housing and the curved surface in substantially the direction of the space between said pair of opposed detection means and the direction of the curvature of the curved surface.

28. A method for counting hangers having a convex surface comprising: causing relative movement of a counting device and a row of hangers; projecting a beam of light from the counting device to the surface of the hanger, detecting a reflection of the projected beam from each of the upwardly curved and downwardly curved portions of the convex surface; and determining whether the reflected beams were detected in a sequence characteristic of the relative displacement of the counting device and the convex surface.

29. The method for counting hangers, as claimed in claim 28, further comprising: indicating each occurrence of a detection of a reflected light sequence characteristic of the convex surface.

30. The method for counting hangers, as claimed in claim 29, further comprising coding the light beam.

31. The method for counting hangers, as claimed in claim 29, further including determining if the time elapsed between detected reflected beams exceeds a predetermined period.

32. An apparatus for counting hangers having a convex surface comprising: a housing; a central detection means for detecting a projected light beam from the convex surface; a pair of spaced light source means positioned on said housing on substantially opposed sides of said central light detection means for projecting light beams on the convex surface; and detecting circuit means coupled to a pair of spaced light detection means for detecting a sequence of reflected light beams characteristic of the relative displacement of the housing and convex surface in substantially the direction of the space between said pair of opposed light source means and the direction of the curvature of the convex surface.

33. An apparatus for counting hangers as claimed in claim 32, further comprising an indicator means coupled to the detecting circuit means for indicating when a proper sequence of reflected light beams has been detected by the detecting circuit means representative of the count of a hanger.

34. An apparatus for counting hangers as claimed in claim 32, further comprising a counter means coupled to the detecting circuit means for counting each successive detection indication of the convex surface of a hanger.

35. An apparatus for counting hangers as claimed in claim 32, further comprising a light beam coding means coupled to the light source means for coding the beam of light produced by the pair of spaced light source means.

36. An apparatus for counting hangers as claimed in claim 32, further comprising a guide means adjacent the light source means and light detection means carried by the housing for guiding the apparatus along a group of hangers.

37. An apparatus for detecting a curved surface comprising: a housing; a central detection means carried by said housing for detecting a projected light beam from the curved surface; a pair of spaced light source means positioned on said housing on substantially opposed sides of said central light detection means for projecting light beams on the curved surface; the central detection means detects a sequence of reflected light beams characteristic of the relative displacement of the housing and the curved surface in substantially the direction of the space between said pair of opposed detection means and the direction of the curvature of the curved surface.

* * * * *